United States Patent [19]

Huling

[11] 4,333,498

[45] Jun. 8, 1982

[54] STEPPER MOTOR ACTUATED SERVOVALVE

[75] Inventor: Don W. Huling, Kent, Wash.

[73] Assignee: The Boeing Company, Seattle, Wash.

[21] Appl. No.: 127,284

[22] Filed: Mar. 5, 1980

[51] Int. Cl.[3] ..... F15B 13/043

[52] U.S. Cl. ..... 137/625.62; 137/625.64

[58] Field of Search ..... 137/625.62, 625.64; 251/133

[56] References Cited

U.S. PATENT DOCUMENTS

| | | | |
|---|---|---|---|
| 3,536,296 | 10/1970 | Burris | 251/208 |
| 3,919,923 | 11/1975 | Haigh | 137/625.62 X |
| 4,145,956 | 3/1979 | Rumrill et al. | 137/625.64 X |

*Primary Examiner*—Gerald A. Michalsky

*Attorney, Agent, or Firm*—Ronald E. Suter; Bernard A. Donahue

[57] ABSTRACT

A servovalve of the type wherein changes in two primary control pressures, as determined by a primary stage valve, positions a secondary output control valve. The primary stage valve is in the form of two nozzles which direct fluid jets against opposite sides of a rotatable cylinder such that the back pressures from the two jets, which control the position of the secondary output control valve, can be varied as the cylinder rotates. The cylinder is driven by a stepper motor which, in turn, can be controlled by the output of digital computer apparatus.

3 Claims, 6 Drawing Figures

STEPPER MOTOR ACTUATED SERVOVALVE

BACKGROUND OF THE INVENTION

Servovalves in which a primary stage valve is used to control a secondary output control valve have been used extensively in the past. In such valves, the secondary output valve usually comprises a spool, spring-biased to a central, null position (or to the primary stage valve) which can be shifted in one direction or the other by differential pressure operating at opposite ends of the spool. The differential pressure, in turn, is controlled by a primary stage valve which varies the back pressure generated by two nozzles which direct jets onto the primary stage valve. It is these back pressures which act on the spool to move it in one direction or the other from its central, null position.

In the past, it has been common to control the position of the primary stage valve with an analog torque motor. Such torque motors, however, are subject to null shift or flow gain changes which adversely affect the operation of the valve. Furthermore, the electronic systems controlling the torque motors have a tendency for hardover failures.

SUMMARY OF THE INVENTION

In accordance with the present invention, a new and improved servovalve is provided wherein an electrical analog signal input is replaced by an electrical stepper input signal. The use of a stepper motor in place of the generally-used torque motor renders the servovalve receptive to a signal that is more easily and reliably converted from a digital computer signal. Since many aircraft now use digital computers for their automatic flight controls (e.g., autopilot, stability augmentation, etc.), a digital stepper motor will readily interface with devices which are most effectively receptive to a digital signal. The stepper hydraulic servovalve of the invention has a significantly lower tendency for hardover failures and null shift or flow gain changes which are currently major problems with flapper and jet-pipe servovalves.

The above and other objects and features of the invention will become apparent from the following detailed description taken in connection with the accompanying drawings which form a part of this specification, and in which.

Figure 1:
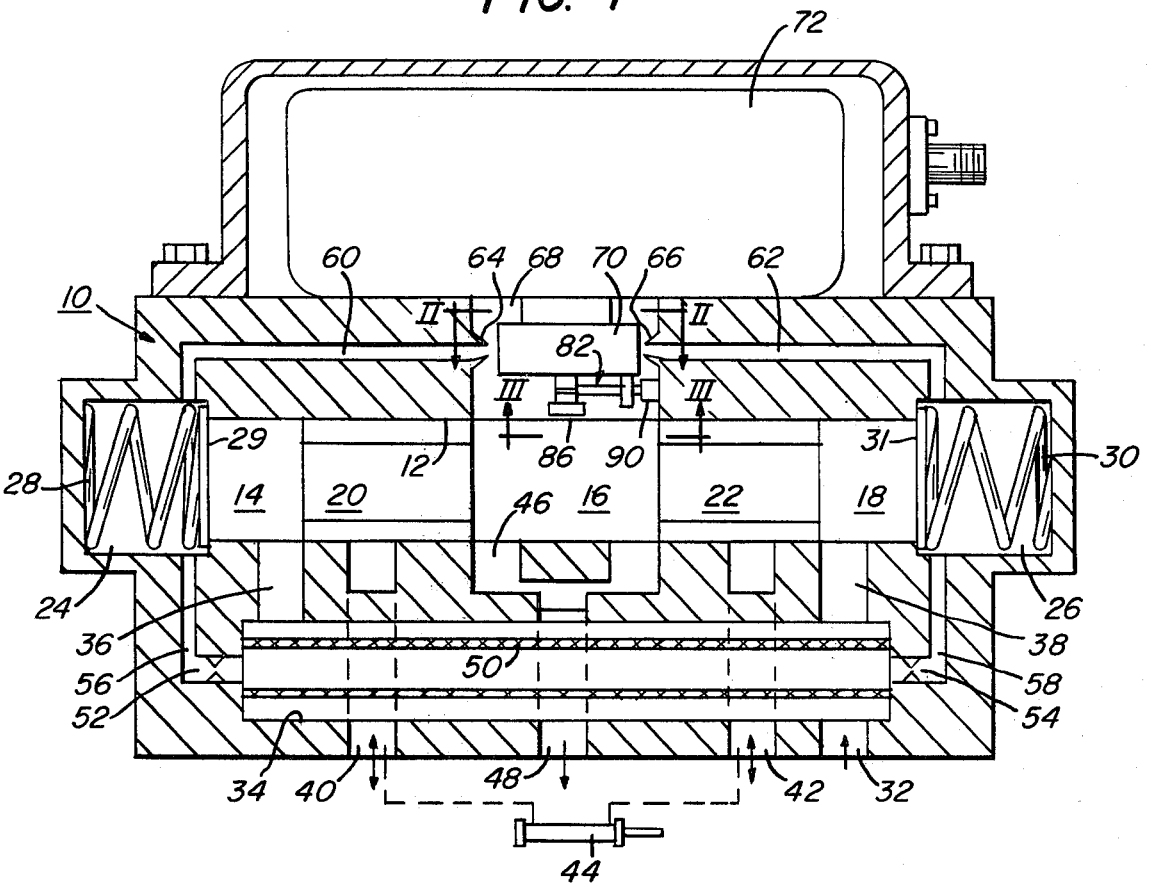
FIG. 1 is a schematic cross-sectional view of the servovalve of the invention.

With reference now to the drawings, and particularly to FIG. 1, the valve shown includes a valve body 10 having a central bore 12 extending therethrough. Slideable within the bore 12 is a spool valve element comprising three enlarged diameter portions 14, 16 and 18 separated by small diameter portions 20 and 22, the large diameter portions 14–18 being slideable on the inner periphery of the bore 12. At opposite ends of the spool valve are chambers 24 and 26 containing coil springs 28 and 30 which press against stops 29 and 31, grounding the opposite ends of the spool valve element and detenting it into the central, null position shown.

Formed in the valve body 10 is a pressure input or inlet port 32 adapted to be connected through bore 34, passageway 36 or passageway 38 with the bore 12 containing the spool valve element. The space surrounding the reduced diameter portions 20 and 22 is in communication with output ports 40 and 42 which may, for example, be connected to the opposite ends of a hydraulic cylinder and piston arrangement 44. Surrounding the enlarged diameter portion 16 and the spool valve element is an annular chamber 46 connected through port 48 to a hydraulic reservoir, not shown. The reservoir, as is conventional, can then be connected to a pump, the output of which is connected to the input port 32.

With the spool valve element in the position shown, fluid under pressure in passageways 36 and 38 is prevented from entering the bore 12 by the enlarged diameter portions 14 and 18. However, if the spool valve element should move to the left, for example, fluid will now flow from passageway 36 into the bore 12 and through output port 40 to one side of the cylinder 44. Fluid returned from the opposite side of the cylinder enters port 42; and since the enlarged diameter portion 16 has now moved to the left, it will flow through annular space 46 to port 48 where it is returned to the reservoir.

Within the bore 34 is a tubular filter element 50 which communicates at its opposite ends with two metering orifices 52 and 54. The orifices 52 and 54 are in passageways 56 and 58 which communicate with the chambers 24 and 26. Also connected to the chambers 24 and 26 are passageways 60 and 62 which terminate in nozzles 64 and 66. The nozzles 64 and 66 direct jets of fluid into a chamber 68 which is in communication with the annular space 46 and, hence, the return port 48 connected to a fluid reservoir. The jets from nozzles 64 and 66 impinge on a rotary valve element 70 which is connected to a stepping motor 72 above the valve body 10. As the stepping motor 72 advances, so also will the cylindrical valve element 70.

Various embodiments of the valve element 70 are shown in FIGS. 2A–2D. In the embodiment shown in FIGS. 2A and 2B, a groove 74 extends around the periphery of the valve element. The center of curvature 71 of the groove 74 is offset with respect to the axis of rotation 73 of the valve element 70 such that as the valve element is rotated in one direction or the other from the null position shown in FIG. 2A, the distance between the nozzles 64 and 66 and the bottom of the grooved portion of the peripheral surface will vary. If it is assumed, for example, that the valve element 70 rotates in a clockwise direction as viewed in FIG. 2A, the distance between nozzle 66 and the bottom of the groove will decrease; while the distance between the nozzle 64 and the bottom of the groove or periphery of the valve element will increase. This will cause a back pressure in chamber 26 greater than that in chamber 24, thereby causing the spool valve to move to the left to connect passageway 46 to output port 42 and passageway 36 to port 40. When the cylindrical rotary valve 70 rotates in the opposite direction, the opposite effect is produced with the spool valve moving to the right.

Figure 2A:
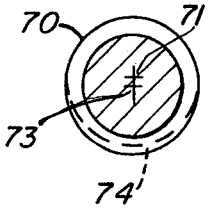
FIG. 2A is a view taken substantially along line II—II of FIG. 1 showing a top view of one embodiment of the rotatable primary stage valve utilized in the invention.
Figure 2B:
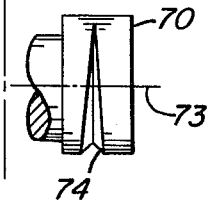
FIG. 2B is a side view of the embodiment shown in FIG. 2A.
Figure 2C:
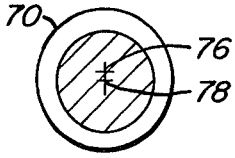
FIG. 2C is a top view of another embodiment of the rotatable primary stage valve utilized in the invention.

In FIG. 2C, another embodiment of the rotary valve element 70 is shown wherein the outer periphery of the cylindrical valve element is smooth; however the axis of rotation 76 of the valve element is offset with respect to the axis 78 of the peripheral surface of the cylinder in an eccentric arrangement. Consequently, as the valve element is rotated in one direction or the other, the distance between nozzle 66 and the periphery of the valve element will increase while the distance between nozzle 64 and the periphery decreases, and vice versa.

Figure 2D:
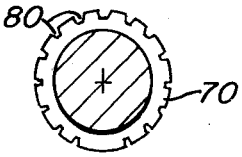
FIG. 2D is a top view of still another embodiment of the rotatable primary stage valve utilized in the invention.

In FIG. 2D, still a further embodiment of the invention is shown wherein the valve element 70 is provided with notches 80 on its outer periphery of varying depth and/or width. These are spaced around the periphery of the valve element such that each time the stepping motor 72 advances the valve element through one step, a slot of different cross-sectional area will be presented to the respective nozzles 64 and 66 to thereby produce the differential action explained above.

Figure 3:
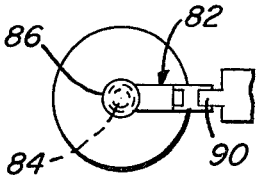
FIG. 3 is a view taken substantially along line III—III of FIG. 1 illustrating the centering spring for the rotatable primary stage valve utilized in the invention.

In FIG. 3, a centering spring 82 for the valve element 70 is shown. It comprises a coil spring 84 wound around a pin 86 depending downwardly from the bottom surface of the valve element and having legs which abut a projection 90 extending into the chamber 68.

Stepper motors, such as motor 72, exist which can step 1000 steps per second, meaning that the response times can be very short. A second advantage is that stepper motors have an inherent feedback built into them. That is, they step in precise motion, meaning that their position is measured by counting the step commands issued. This system, therefore, provides a direct digital interface with a reasonable response capability and without requiring a separate feedback device to determine the position of the rotary valve.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A servovalve comprising a valve body having a bore therein, a spool valve element reciprocable within said bore for controlling communication between an inlet pressure port in the valve body and a pair of output ports, opposed spring means carried in chambers located at opposite ends of said bore for urging said spool valve element into a null position where the input port is disconnected from both of said output ports, means for metering fluid under pressure from said input port to both of said chambers, opposed nozzles connected to the respective chambers and adapted to produce jet streams of fluid directed toward each other, a rotary valve member interposed between said nozzles and configured such that the jets impinge thereon and the distance between the respective nozzles and at least a portion of the surface of the rotary valve member can differ depending upon the angular position of the rotary valve member about its axis of rotation, and stepper motor means for rotating said valve element in stepped increments;

said rotary valve member comprising a cylinder rotatable about an axis normal to the flat end surfaces thereof, said cylinder including a groove in the periphery thereof, the cross-sectional area of which varies circumferentially therearound.

2. The servovalve of claim 1 wherein the radius of curvature of said groove is centered about an axis offset with respect to the axis of rotation of the cylinder whereby said groove center is eccentric relative to said jets.

3. The servovalve of claim 1 including centering spring means for returning said rotary valve member to a null position.

* * * * *